US005520564A

United States Patent [19]

DeMars

[11] Patent Number: 5,520,564

[45] Date of Patent: May 28, 1996

[54] LARGE BUBBLE PRODUCING TOY

[76] Inventor: Robert A. DeMars, 23221 Ladrillo Ave., Woodland Hills, Calif. 91367

[21] Appl. No.: 492,330

[22] Filed: Jun. 19, 1995

[51] Int. Cl.[6] ..... A63H 33/28; A63H 33/30

[52] U.S. Cl. ..... 446/15; 446/475

[58] Field of Search ..... 446/15, 16, 17, 446/18, 19, 20, 21, 475, 489, 484

[56] References Cited

U.S. PATENT DOCUMENTS

| | | | |
|---|---|---|---|
| 2,133,499 | 10/1938 | Dolan | 446/15 X |
| 2,606,395 | 8/1952 | Fulton | 446/15 |
| 4,790,787 | 12/1988 | Rector | 446/15 |
| 4,943,255 | 7/1990 | Klundt | 446/15 |
| 5,334,087 | 5/1994 | Messina | 446/15 |

*Primary Examiner*—Robert A. Hafer
*Assistant Examiner*—D. Neal Muir
*Attorney, Agent, or Firm*—Jack C. Munro

[57] ABSTRACT

A hand holdable, large bubble producing toy (10) that when activated by a human produces a thin soapy membrane across an air space. Movement of air into the air space results in the production of one or more large bubbles. Activation of the toy (10) is accomplished by manually moving of a pivot arm (76) which electrically operates a pump to supply soapy liquid (54) along the entire length of a pair of half loop members (80,86). Movement of the half loop members (80,86) from an abutting alongside position to an aligned position will encircle the air space and will result in the production of a thin soapy membrane across the air space through which air will be moved to form bubbles.

3 Claims, 3 Drawing Sheets

LARGE BUBBLE PRODUCING TOY

BACKGROUND OF THE INVENTION

1) Field of the Invention

The field of this invention relates to toys and more particularly to a hand holdable toy, normally used by a child, that dispenses one or more large soap bubbles.

2) Description of the Prior Art

Trigger actuated toys which are used to produce soap bubbles by children have previously been known. Reference is to be had to U.S. patent application Ser. No. 08/391,104, filed Feb. 21, 1995 entitled BUBBLE PRODUCING TOY by the present inventor. The desirability of such a toy is that it propels a harmless soap bubble which is entertaining to a child.

The toy of the aforementioned patent application produces bubbles which are small in size and are essentially similar to what would be produced by the exceedingly old and common bubble producing toy of a hand holdable ring that is to be inserted within a quantity of soapy liquid solution and, when removed and blown upon by the child, will produce bubbles. Prior to the present invention it has not been known to construct a toy that produces large sized bubbles. Large sized bubbles are bubbles that are several inches or more in diameter and may be a foot or more in length.

SUMMARY OF THE INVENTION

The large bubble producing toy of the present invention utilizes a pair of half loop members which are to be movable from an abutting alongside position to an aligned position. The movement of each half loop member is approximately ninety degrees from the alongside position to the aligned position. When in the aligned position, the half loop members encircles an air space. Incorporated within each half loop member is a liquid distribution channel which runs the length of the loop member within each half loop member and including a mass of bleed holes connecting with the distribution channel. These half loop members are mounted on a housing. Also mounted on the housing is a manually operable pivot arm. Initial movement of the pivot arm will result in operation of a pump that is to dispense soapy liquid from a reservoir to within the distribution channels of the half loop members. The soapy liquid then bleeds through the bleed openings and further movement of the pivot arm will result in the half loop members being spread apart to the aligned position. A thin soapy membrane is formed across the air space and upon air being moved into contact with the membrane, one or more of a plurality of large sized bubbles will be produced. Excess soapy liquid is permitted to drain from the half loop members into a collection funnel back into the reservoir.

One of the primary objectives of the present invention is to construct an entertaining and safe toy for a child which discharges a plurality of harmless air bubbles.

Another objective of the present invention is to construct a large bubble producing toy with a recovery system for surplus soapy liquid and discharges such back into the reservoir that maintains the supply of soapy liquid used in the making of the bubbles.

Another objective of the present invention is to construct a large bubble producing toy which is capable of being manufactured at a reasonable cost and therefore sold to the ultimate consumer at a reasonable cost.

DETAILED DESCRIPTION OF THE PREFERRED EMBODIMENT

Figure 1:
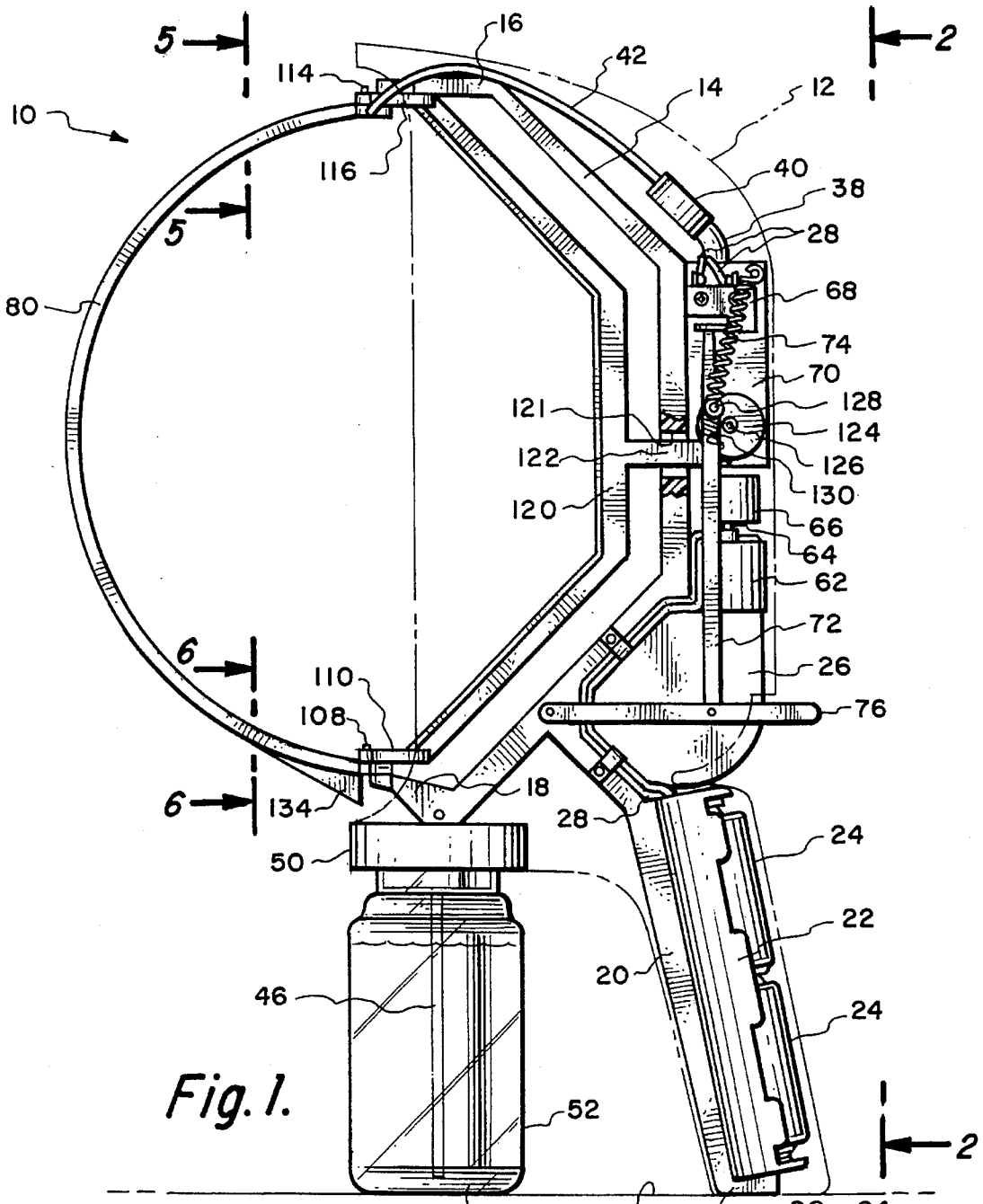
FIG. 1 is a side elevational view of the large bubble producing toy of the present invention showing the toy in its non-activated position.
Figure 5:
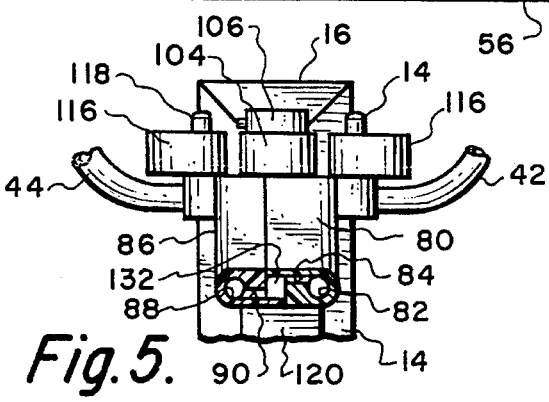
FIG. 5 is a cross-sectional view taken through the half loop members of the large bubble producing toy of the present invention taken along line 5—5 of FIG. 1.

Referring particularly to the drawings, there is shown a large bubble producing toy 10 of this invention. Toy 10 is to include an exterior covering housing 12 which is shown in phantom lines in FIG. 1. This exterior housing 12 has been removed from the drawings in order to clearly illustrate the internal components of the toy 10. There is an internal housing in the form of a U-shaped rigid member 14 which terminates at an upper end 16 and a lower end 18. The member 14 normally will be constructed of a rigid material such as plastic. Integrally connected to the member 14 and extending outwardly therefrom is an extension 20. The outer portion of the extension 20 has fixedly mounted thereto a battery cradle 22. Mounted within the battery cradle 22 is to be a pair of conventional batteries 24.

Figure 3:
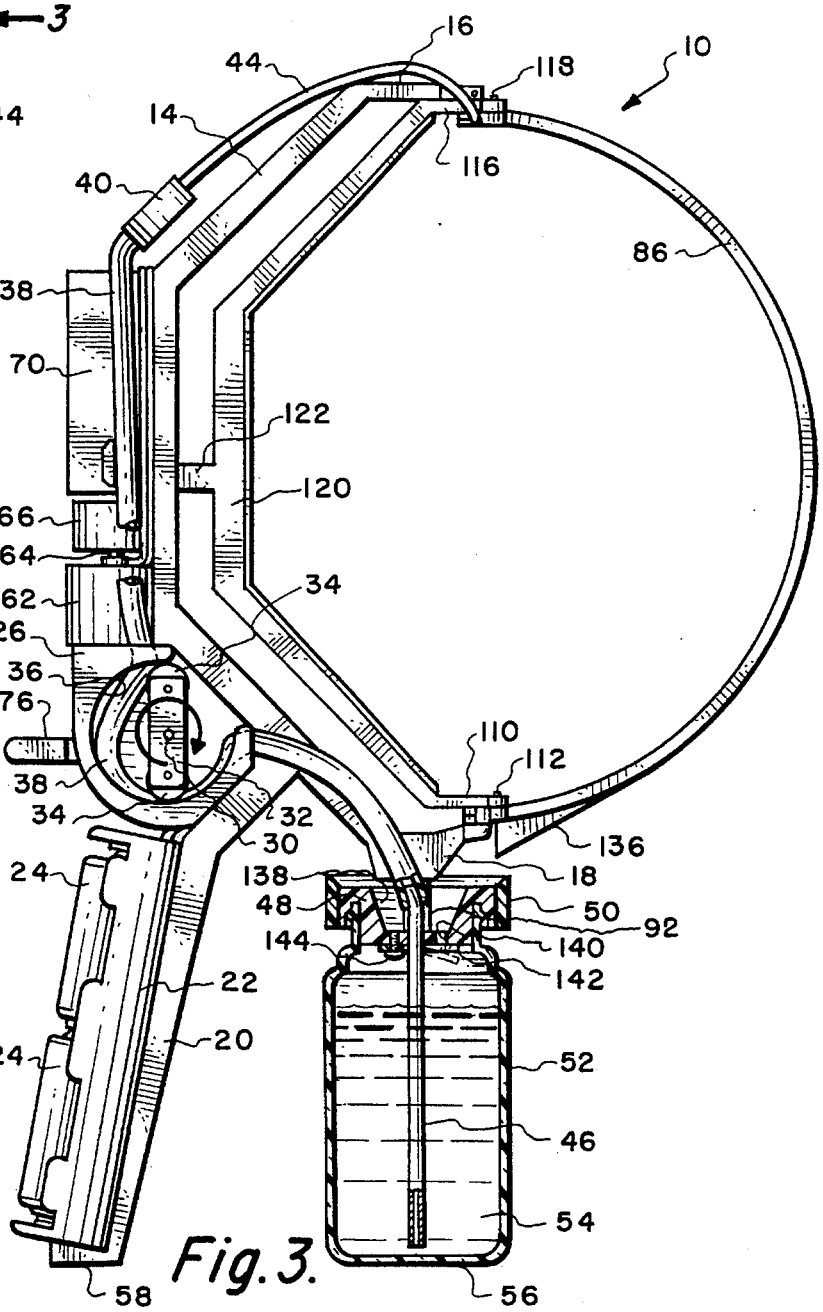
FIG. 3 is a right side, partly in cross-section, view of the large bubble producing toy of the present invention taken along line 3—3 of FIG. 2.
Figure 7:
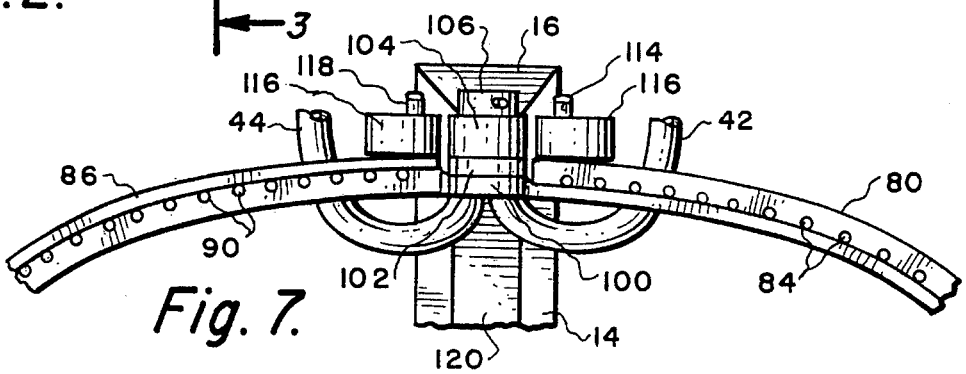
FIG. 7 is a front view of a portion of the large bubble producing toy of the present invention taken along line 7—7 of FIG. 4.

Mounted in conjunction with the rigid member 14 and extension 20 is a peristaltic pump which is shown only by the pump housing 26. The peristaltic pump 26 is to be electrically driven through wires 28 from the batteries 24. When electrically driven, the peristaltic pump 26 will rotate a shaft 30 shown in FIG. 3. Fixedly mounted on the shaft 30 is an arm 32. Mounted in conjunction with each end of the arm 32 is a roller 34 with it being understood there are two in number of such rollers 34. The rollers 34 rotate within a chamber 36. Located in the chamber 36 directly adjacent the sidewall of the chamber 36 is a flexible rubber tube 38. The upper end of the tube 38 is connected to a block 40. Block 40 functions to divide the flow of liquid from the tube 38 into small discharge conduits 42 and 44. The lower end of the tube 38 is fixedly connected to a rigid dispensing tube 46. The rigid dispensing tube 46 is fixedly mounted within a cap 48. Exteriorly mounted on the cap 48 is a collar 50. Threadably secured to the cap 48 is a reservoir in the form of a container 52. Contained within the container 52 is a quantity of soapy liquid 54. The dispensing tube 46 is to extend directly adjacent the bottom wall 56 of the container 52. The bottom wall 56, in conjunction with the base 58 of the extension 20, is to be placable on a level supporting surface 60 which will locate the toy 10 in an upright, at-rest position when not in use.

The pump located within the pump housing 26 is to be operated by means of electrical motor 62. Wires 28 also connect with the motor 62. The motor 62 also drives by means of shaft 64 a cylindrical block 66. The block 66 is to include a line on its exterior surface that when spun, is usable to ascertain the revolutions per unit of time of the motor 62.

Wires 28 also connect to switch 68. Switch 68 is mounted on a plate 70 which is integral with the U-shaped member 14. The switch 68 is normally closed by being contacted by the upper end of the arm 72. Arm 72 connects to coil spring 74 with one end of the coil spring being fixedly mounted onto the plate 70. The coil spring 74 exerts a continuous bias tending to locate the arm 72 against the switch 68 and keep the switch 68 closed.

Figure 4:
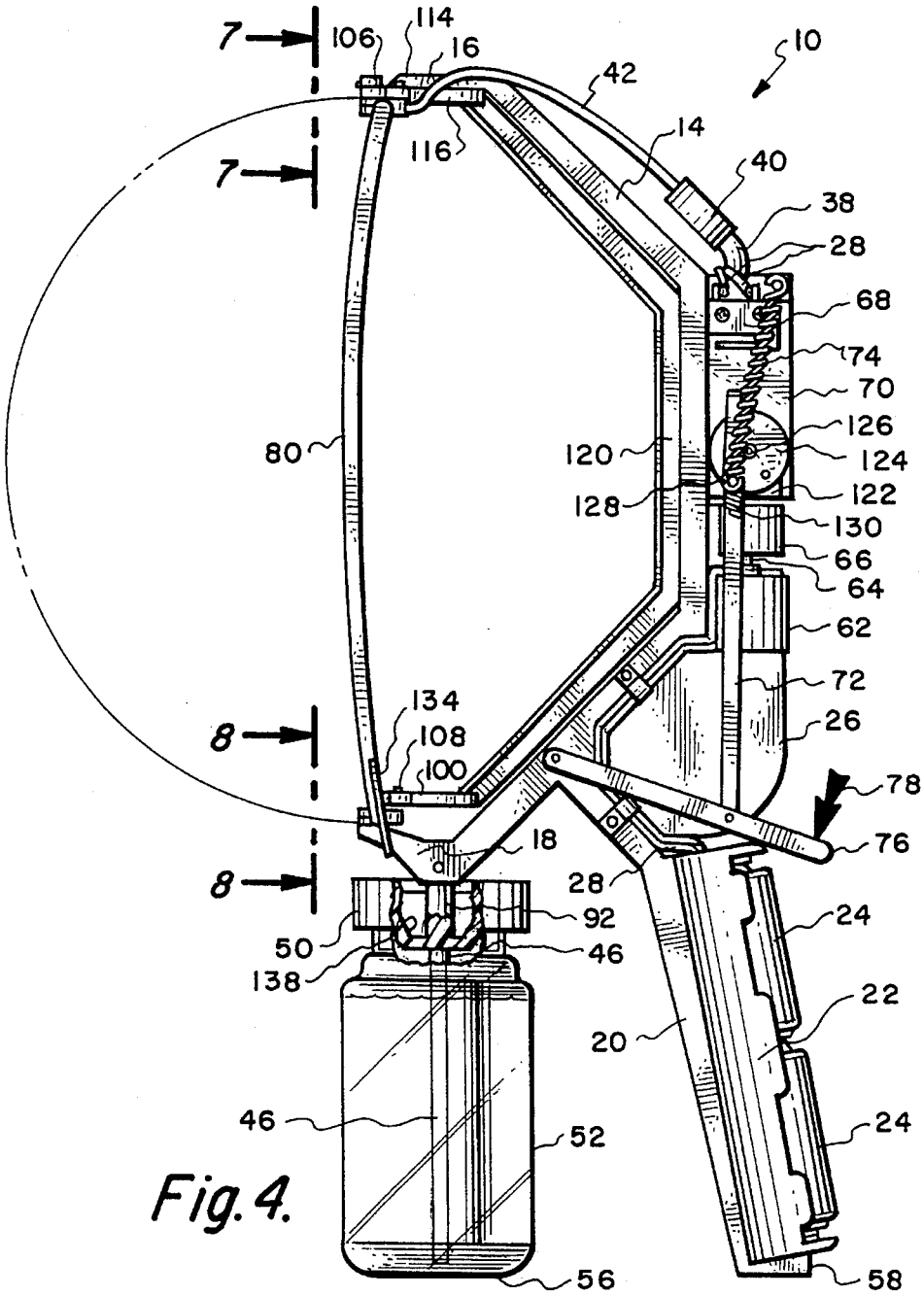
FIG. 4 is a left side, elevational view, partly in cross section, similar to FIG. 1 but showing the bubble producing toy in the activated position.
Figure 8:
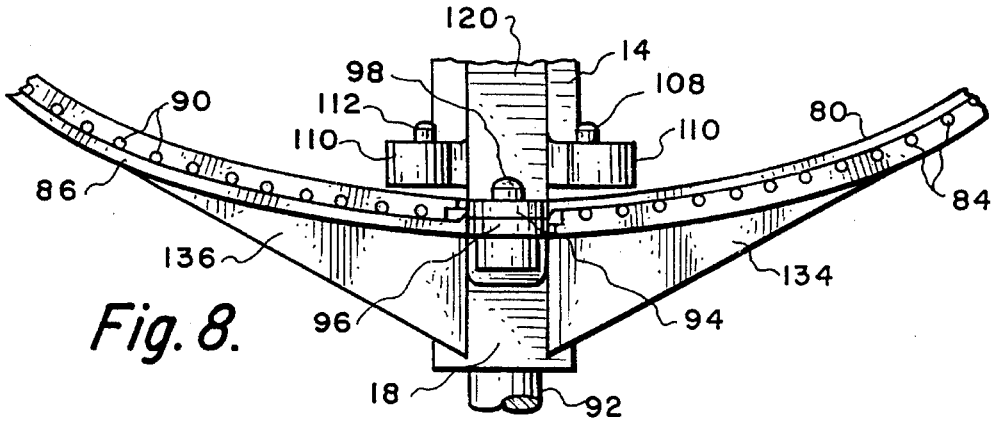
FIG. 8 is a front view of another portion of the large bubble producing toy of the present invention taken along line 8—8 of FIG. 4.

The lower end of the arm 72 is mounted onto a pivot arm 76. The pivot arm 76 is pivotally mounted onto the member 14. The extension 20 is to function as a handle for the user with the user being able to manually press by finger or thumb pressure on the pivot arm 76 pivoting the pivot arm 76 relative to the member 14. This downward pressing movement is depicted by arrow 78 in FIG. 4. This downward pressing movement will locate the upper end of the arm 72 in a spaced relationship from the switch 68 which will electrically operate the motor 62 and hence the pump within the pump housing 26 and rotation of the cylindrical block 66. The rollers 34 press and roll against the tube 38 that is located within the chamber 36. This pressing movement of the rollers 34 pushes soapy liquid 54, that has been sucked through the dispensing tube 46 into the tube 38, through the block 40 into the discharge conduits 42 and 44. Discharge conduit 42 connects to a half loop member 80. Discharge conduit 44 connects to a half loop member 86. The half loop member 80 is basically semicircular in configuration. The soapy liquid that is supplied to the half loop member 80 flows through an inner channel 82 exteriorly through a mass of bleed holes 84. The bleed holes 84 connect with the outer channel 132 formed between the half loop members 80 and 86. The half loop member 86 is basically identical to half loop member 80 and includes an inner channel 88 which also connects with a mass of bleed holes 90.

Figure 6:
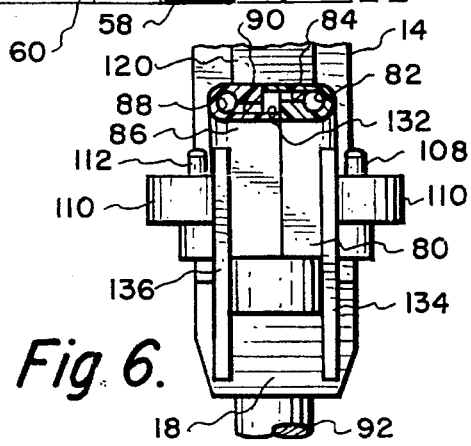
FIG. 6 is a cross-sectional view through another portion of the half loop members included within the large bubble producing toy of the present invention taken along line 6—6 of FIG. 1.
Figure 2:
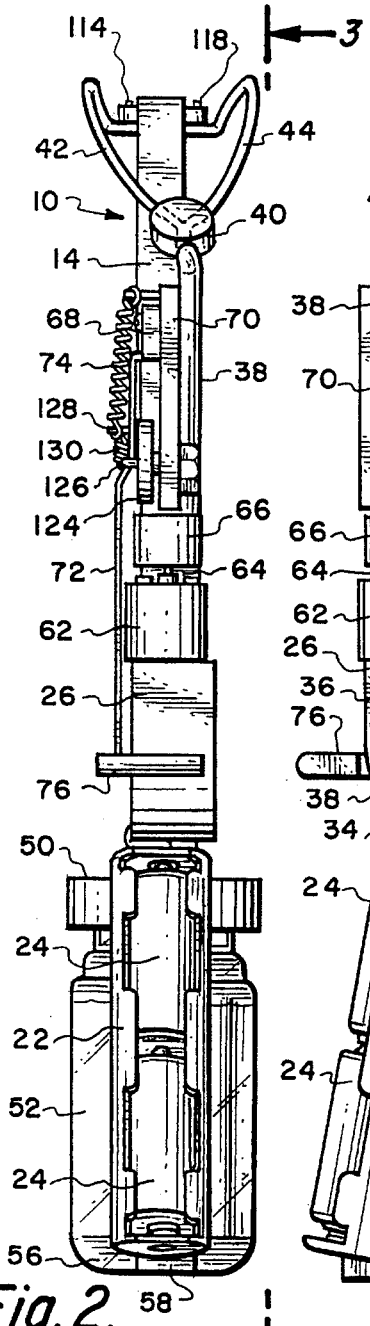
FIG. 2 is a back view of the large bubble producing toy of the present invention taken along line 2—2 of FIG. 1.

The lower end 18 is fixedly secured to a pin 92 as shown in FIG. 6. This pin 92 is centrally positioned relative to the cap 48 and extends upwardly therefrom. It is the function of the pin 92 to fixedly mount the cap 48, and hence the container 52, on the lower end 18 of the member 14. It is to be understood that the container 52 can be removably disengaged from the cap 48 in order to facilitate refilling of the container 52 of the soapy liquid 54.

The lower end of the half loop member 80 terminates in a disk 94. The lower end of the half loop member 86 terminates in a disk 96. These disks 94 and 96 are located in juxtaposition with a pin 98 extending through aligned center openings of the disks 94 and 96. The pin 98 is fixedly mounted on the lower end 18.

The upper end of the half loop member 80 terminates in a similar disk 100 with this disk 100 being located in juxtaposition with disk 102 which constitutes the upper terminal end of the half loop member 86. Mounted through the disks 100 and 102 is a pin which is not shown which is similar to pin 92. This pin not only passes through the disks 100 and 102 but also through a hole (not shown) formed within disk shaped end 104 of the upper end 16. A sleeve 106 is fixedly mounted on the outer end of this pin whose function is to keep the disks 100 and 102 in the closely mounted arrangement with the disk shaped end 104.

The lower end of the half loop member 80 has mounted thereon an upstanding pin 108. The upstanding pin 108 is to fit within a hole formed within one leg of a U-shaped yoke 110. The opposite leg of the yoke 110 has a similar hole which connects with an upstanding pin 112 which is fixedly secured to the lower end of the half loop member 86. In a similar manner the upper end of the half loop member 80 has mounted thereon an upstanding pin 114 which is located within a hole formed within one leg of a U-shaped yoke 116. The opposite leg of the yoke 116 includes a hole which engages in a similar manner with an upstanding pin 118 which is fixedly mounted on the upper end of the half loop member 86.

The yoke 110 is integral with the lower end of a U-shaped actuating bar 120. The yoke 116 is integral with the upper end of the U-shaped actuating bar 120. Connecting with the actuating bar 120 is an arm 122. This arm 122 passes through aperture 121 formed in member 14. Arm 122 is pivotally mounted on a wheel 124 with this wheel 124 being rotationally mounted by shaft 126 to plate 70. Mounted on the wheel 124, adjacent its periphery, is a pin 128. The pin 128 is supported within a slightly oversized slot which is formed within the arm 72. This oversized slot is not discernable within the drawings. Supported between the pin 128 and the arm 72 is a small coil spring 130. The function of the coil spring 130 is to exert a continuous bias tending to locate the arm 72 in contact with the switch 68.

The operation of the large bubble producing toy 10 of this invention is as follows. The user grasps the extension 20 and uses it as a handle in conjunction with the battery cradle 22 and batteries 24. Actually, as previously mentioned, there would be a covering housing 12 covering the extension 20, cradle 22 and batteries 24. The user is to begin to apply pressure on the pivot arm 76 in the downward direction as represented by arrow 78. Only a very slight amount of movement is required for the arm 72 to disengage from the switch 68 with motor 62 then operating the pump within the pump housing 26. The small coil spring 130 is slightly stretched with the pin 128 moving from the lower end of the oversized hole formed within the arm 72 to the upper end of the oversized hole. This movement is actually about 1/16 of an inch. The reason for this arrangement is so that when the pivot arm 76 is initially moved and the electric motor in motor housing 26 is activated, the soapy liquid 54 is pumped within each of the inner channels 82 and 88 of the half loop members 80 and 86, respectively. As the pivot arm 76 is continued to move in the downward direction, the arm 72 presses against the pin 128 and causes the wheel 124 to pivot. This pivoting action causes the arm 122 to be moved inwardly which will result in actuating bar 120 being moved into physical contact with the member 14. When the actuating bar 120 is in physical contact with the member 14, the half loop members 80 and 86 are located in an aligned position and in essence form a circle. As the half loop members 80 and 86 are moved from their abutting alongside position shown in FIGS. 1 and 3 of the drawings, the soapy liquid 54 that is dispersed throughout the outer channel 132 adheres by capillary action to the surface of the half loop members 80 and 86 with the result that as the members are moved apart a thin soap film membrane will be stretched across the air space encircled by the half loop members 80 and 86 when such are in the aligned position which is depicted within FIG. 4 of the drawings. At that time upon an air wind being moved through this air space, a large soap bubble will be produced. The air can be moved through the air space by surface wind or by the user manually moving the toy laterally through the air.

Upon a soap bubble being released, the user is to release the pivot arm 76 permitting the half loop members 80 and 86 to be then moved to their abutting alongside position. Upon pressing again the pivot arm 76 and moving again half loop members 80 and 86 to their aligned position, another soap film membrane will be created which when contacted by wind, will result in the production of another large soap bubble.

There always will be an excess amount of soapy liquid 54 supplied to the half loop members 80 and 86. Most of this excess liquid 54 will automatically drain toward lower end 18. This excess liquid 54 follows along the surface of fins 134 and 136 and then fall by gravity into funnel 138 of cap 48. From funnel 138, the excess liquid 54 flows through hole 140, past one way valve 142, into the container 52. One way valve 142 comprises a thin piece of rubber or plastic which deflects under the weight of the excess liquid 54 to permit entry into the container 52. The one way valve is fixedly mounted by screw 144 to the underside of cap 48. The deflected position of one way valve 142 is shown in phantom lines in FIG. 3. This one way valve 142 prevents flow of the soapy liquid 54 through hole 140 if the toy 10 and container 52 are turned upside down.

What is claimed is:

1. A large bubble producing toy comprising:

a housing, said housing including a handle adapted to be grasped by a human;

a pair of half loop members mounted on said housing, said half loop members being repeatedly movable between an alongside position and an aligned position, with said half loop members in said aligned position said half loop members forming a frame encircling an air space;

a liquid reservoir mounted on said housing, said liquid reservoir to contain a quantity of soapy liquid;

liquid channel means formed on said half loop members for distributinq said soapy liquid along said half loop members;

pump means mounted on said housing, said pump means being connected to said liquid reservoir, said pump means being operable to move said soapy liquid from said liquid reservoir to said liquid channel means;

activation means on said housing attached to said half loop members and in communication with said pump means to activate said pump means then move said half loop members to said aligned position; and whereby upon activation of said pump means said soapy liquid is moved to said liquid channel means distributinq a portion of said soapy liquid along said half loop members that are located in said alongside position and upon movement of said half loop members to said aligned position a membrane is formed between said half loop members of said soapy liquid across said air space; and said liquid reservoir being removably and replaceably mounted on said housing.

2. A large bubble producing toy comprising:

a housing, said housing including a handle adapted to be grasped by a human;

a pair of half loop members mounted on said housing, said half loop members being repeatedly movable between an alongside position and an aligned position, with said half loop members in said aligned position said half loop members forming a frame encircling an air space;

a liquid reservoir mounted on said housing, said liquid reservoir to contain a quantity of soapy liquid;

liquid channel means formed on said half loop members for distributing said soapy liquid along said half loop members;

pump means mounted on said housing, said pump means being connected to said liquid reservoir, said pump means being operable to move said soapy liquid from said liquid reservoir to said liquid channel means;

whereby upon activation of said pump means said soapy liquid is moved to said liquid channel means distributing a portion of said soapy liquid along said half loop members that are located in said alongside position and upon movement of said half loop members to said aligned position a membrane is formed between said half loop members of said soapy liquid across said air space; and a pivot arm mounted on said housing, movement of said pivot arm by a human causes activation of said pump means and movement of said half loop members from said alongside position to said aligned position and also return movement from said aligned position to said alongside position.

3. The large bubble producing toy as defined in claim 2 wherein:

during the initial portion of said movement of said pivot arm said pump is activated and as said movement continues said half loop members begin to move from said alongside position to said aligned position and also return movement from said aligned position to said alongside position.

* * * * *